US008667937B2

(12) United States Patent
Gallmeyer

(10) Patent No.: US 8,667,937 B2
(45) Date of Patent: Mar. 11, 2014

(54) APPARATUS FOR SENSING CAM PHASER POSITION

(75) Inventor: Christopher Gallmeyer, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 347 days.

(21) Appl. No.: 13/042,159

(22) Filed: Mar. 7, 2011

(65) Prior Publication Data

US 2012/0227696 A1 Sep. 13, 2012

(51) Int. Cl.
*F01L 1/34* (2006.01)

(52) U.S. Cl.
USPC ..... 123/90.17; 123/90.16; 123/90.18; 123/406.59; 123/406.61; 73/114.03; 73/114.04; 73/114.26; 73/114.27; 73/114.28; 702/150; 702/151; 710/110

(58) Field of Classification Search
USPC ..... 123/90.15–90.18, 406.59, 406.61; 73/114.26, 114.03, 114.04, 114.27, 73/114.28; 702/150, 151; 710/110
See application file for complete search history.

(56) References Cited

U.S. PATENT DOCUMENTS 5,715,780 A 2/1998 Haller
6,070,567 A * 6/2000 Kakizaki et al. ..... 123/406.25
6,246,532 B1 * 6/2001 Hori ..... 359/813
6,308,672 B1 * 10/2001 Lichti et al. ..... 123/90.17
6,699,081 B1 3/2004 Divljakovic et al.
7,138,796 B2 11/2006 Miya
7,350,487 B1 * 4/2008 Pfeiffer et al. ..... 123/90.17
7,814,874 B2 10/2010 Kubani et al.
2002/0036495 A1 3/2002 Hannewald et al.
2003/0000498 A1 * 1/2003 Mathews et al. ..... 123/406.62
2003/0217718 A1 * 11/2003 Pierik et al. ..... 123/90.17
2006/0278188 A1 * 12/2006 Payne et al. ..... 123/90.17
2007/0039576 A1 * 2/2007 McCarthy et al. ..... 123/90.15
2007/0215079 A1 9/2007 Boggess et al.
2008/0136404 A1 6/2008 Gauthier et al.
2008/0172160 A1 * 7/2008 Jiang et al. ..... 701/51
2008/0230024 A1 * 9/2008 Kubani et al. ..... 123/90.17
2010/0162977 A1 * 7/2010 Strandburg et al. ..... 123/90.6
2010/0176799 A1 * 7/2010 Ausserlechner ..... 324/207.2
2010/0218738 A1 9/2010 Ai et al.
2010/0242873 A1 9/2010 Meintschel et al.

* cited by examiner

*Primary Examiner* — Kenneth Bomberg
*Assistant Examiner* — Daniel Wagnitz
(74) *Attorney, Agent, or Firm* — Leydig, Voit & Mayer

(57) ABSTRACT

A first target wheel has an opening and rotates about an axis of rotation to move the opening along a generally circular path. A second target wheel adjacent the first target wheel has a second projection projecting into the opening of the first target wheel with the second projection being movable along the generally circular path. A single sensor is positioned adjacent the generally circular path and senses movement of the opening and the second projection past the sensor. An electronic controller may be used to process signals from the sensor to determine the relative angular difference between the first target wheel and the second target wheel.

18 Claims, 6 Drawing Sheets

APPARATUS FOR SENSING CAM PHASER POSITION

TECHNICAL FIELD

This disclosure relates generally to internal combustion engines having variable valve timing capability and, more particularly, to an apparatus for sensing the cam phaser position of the engine.

BACKGROUND

Valve timing within internal combustion engines may be varied to alter performance characteristics and increase efficiency of operation. Some systems use a cam phaser with a first element driven in a fixed relationship to the crankshaft and a second element mounted to the end of the camshaft and adjacent to the first element. In one example, the first element is a stator mounted inside a crankshaft-driven component and having a plurality of radially-disposed inwardly-extending spaced-apart lobes and an axial bore. The second element is a vaned rotor mounted to the end of the camshaft through the stator axial bore and having vanes disposed between the stator lobes to form actuation chambers therebetween such that limited relative rotational motion is possible between the stator and the rotor.

Relative movement between the components of the cam phaser controls the positioning of the camshaft and the valves relative to the crankshaft and the pistons of the engine. In order to efficiently use such a system, the position of the camshaft relative to the crankshaft must be monitored on an ongoing or continuous basis. This sensing of relative position, or cam phase angle sensing, is often determined by monitoring a cam target wheel associated with the second element of the cam phaser to determine the position of the camshaft, monitoring the position of the crankshaft, and comparing their positions to determine the relative angular difference between the camshaft and the crankshaft.

In large engines, tolerance stack-up and torsional issues may impact the accuracy of the relationship between the valves and pistons obtained by monitoring the positions of the camshaft and the crankshaft. Accordingly, it is desirable to increase the accuracy of the cam phase angle sensing without increasing complexity and cost.

The foregoing background discussion is intended solely to aid the reader. It is not intended to limit the innovations described herein nor to limit or expand the prior art discussed. Thus the foregoing discussion should not be taken to indicate that any particular element of a prior system is unsuitable for use with the innovations described herein, nor is it intended to indicate any element, including solving the motivating problem, to be essential in implementing the innovations described herein. The implementations and application of the innovations described herein are defined by the appended claims.

SUMMARY

In one aspect, a system for sensing the relative angular difference between first and second rotating members that rotate relative to each other is provided. The system uses adjacent target wheels associated with the rotating members. A first target wheel has an opening and rotates about an axis of rotation to move the opening along a generally circular path within a plane generally perpendicular to the axis of rotation. A second target wheel adjacent the first target wheel also rotates about the axis of rotation. The second target wheel has a second projection projecting into the opening of the first target wheel with the second projection being rotatable along the generally circular path and about the axis of rotation. A sensor, positioned adjacent the generally circular path, is disposed to sense movement of the opening and the second projection past the sensor. An electronic controller may be used to process signals from the sensor to determine the relative angular difference between the first target wheel and the second target wheel. When used with an internal combustion engine, the system may include a hydraulic system having a cam phaser to change the relative position of the first target wheel and the second target wheel. In this way, the relative angular difference between a camshaft and a crankshaft may be changed control the operating characteristics of the engine.

DETAILED DESCRIPTION

Figure 1:
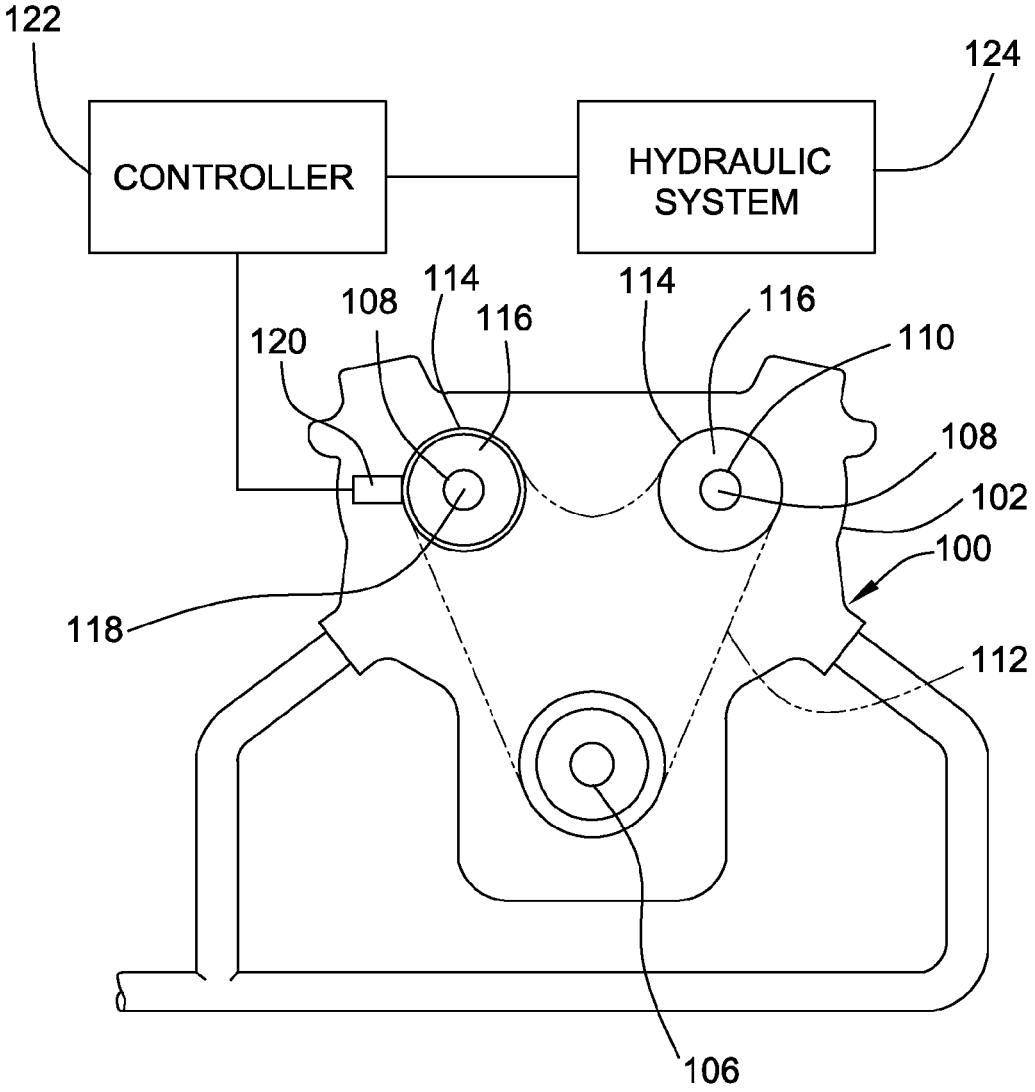
FIG. 1 is a diagrammatic view of an engine and control in accordance with the disclosure.
Figure 2:
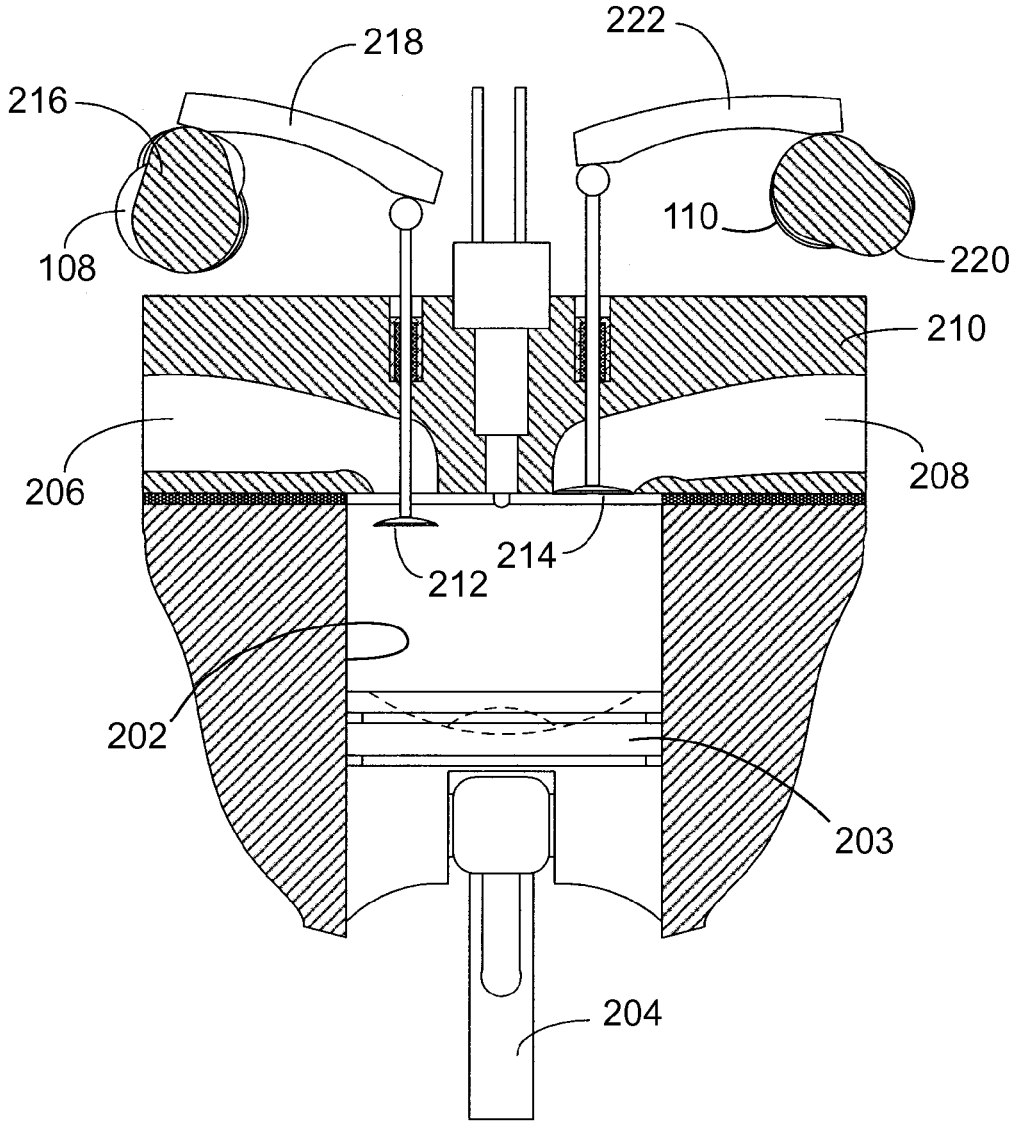
FIG. 2 is a partial cross section of a combustion cylinder of an engine in accordance with the disclosure.

Referring to FIGS. 1-2, internal combustion engine 100 includes a crankcase 102 having a plurality of cylinders 202 with a reciprocating piston 203 mounted in each cylinder. A rotatable crankshaft 106 is coupled to each piston 203 via connecting rod 204 (partially shown). An intake camshaft 108 and an exhaust camshaft 110 are driven by the crankshaft 106 via a timing belt or chain 112 that engages a sprocket 114 on each camshaft. Each cylinder 202 is operably associated with an injector, an intake runner 206, and an exhaust runner 208.

During operation of the internal combustion engine 100, air enters each cylinder 202 via its respective intake runner 206. While in the cylinder 202, the air mixes with fuel injected from the injector to form a combustible mixture. In an alternative embodiment, the fuel is mixed with intake air before it enters the engine cylinders to yield a combustible mixture. In either engine configuration, the combustible mixture is compressed via piston 203 and is ignited by a spark producing device. Although the disclosed embodiment describes a spark ignition engine operating on gaseous hydrocarbon fuel such as natural gas, compression ignition engines or engines operating on gasoline or any other hydrocarbon fuel are contemplated and are suited for the devices disclosed herein. Exhaust gas remaining in the cylinder 202 after ignition is evacuated via the exhaust runner 208 and the process is repeated.

Cylinder 202 includes reciprocating piston 203 therewithin connected to the rotatable crankshaft 106 via connecting rod 204 (partially shown). A cylinder head 210 forms portions of the intake runner 206 and the exhaust runner 208. A reciprocating intake valve 212 is mounted in the cylinder head 210 and disposed to selectively block air entering the cylinder 202 from the intake runner 206. Similarly, a reciprocating exhaust valve 214 is mounted in cylinder head 210 and selectively blocks exhaust gas present in the cylinder 202 after a power stroke of the engine from entering the exhaust runner 208. Although single intake and exhaust valves are shown for simplicity, the internal combustion engine 100 may include multiple valves per cylinder.

As depicted, the opening and closing of the intake valves 212 and exhaust valves 214 in the illustrated embodiment is accomplished by two overhead camshafts, but other configurations may be used. Moreover, although dedicated intake and exhaust camshafts are shown, alternate engine configurations may include a single camshaft operating both the intake and exhaust valves of the engine. In the illustrated embodiment, the intake camshaft 108 includes a plurality of intake lobes 216 that form eccentric features configured to push the intake valve 212 open through a corresponding intake valve bridge 218 as the intake camshaft 108 rotates. Similarly, the exhaust camshaft 110 includes exhaust lobes 220 that push the exhaust valve 214 open through a corresponding exhaust valve bridge 222. Other structures for operating valves of cylinders arranged in any inline, V-shaped, or any other configuration are also contemplated.

In the depicted embodiment, a cam phaser 116 is coupled to both the intake camshaft 108 and exhaust camshaft 110 and each may be hydraulically controlled to create a variable rotational offset between the respective camshafts 108, 110 and the crankshaft 106. The degree of rotational offset generated by each cam phaser 116 enables the internal combustion engine 100 to be tuned for specific performance characteristics by varying the overlap between the intake valves 212 and the exhaust valves 214, as desired. More specifically, performance characteristics of the internal combustion engine may be altered and the efficiency of operation increased by controlling the valve overlap through the cam phasers 116.

Figure 3:
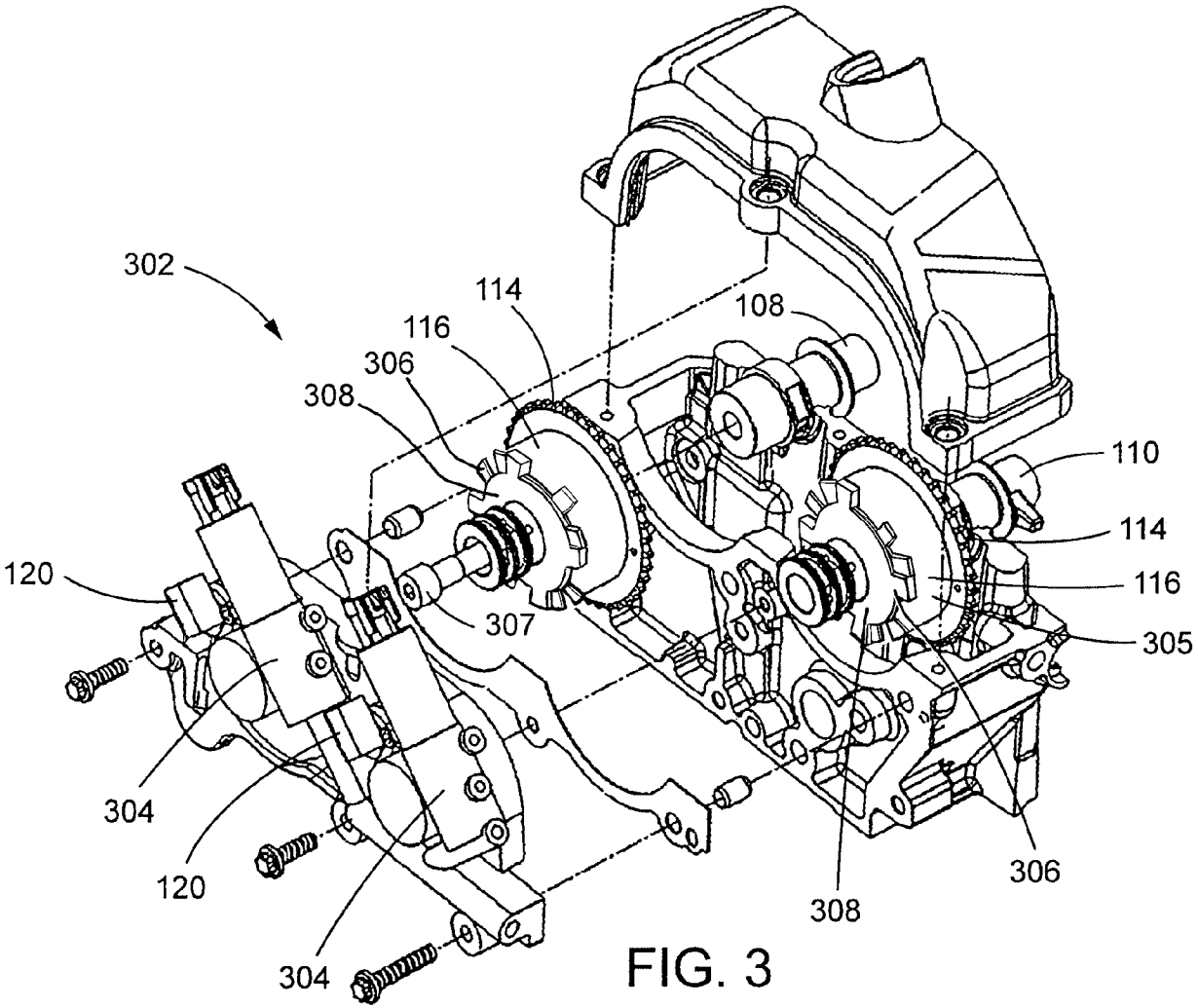
FIG. 3 is an exploded perspective view of a cam phaser sub-assembly together with intake and exhaust camshafts and a cylinder head.
Figure 4:
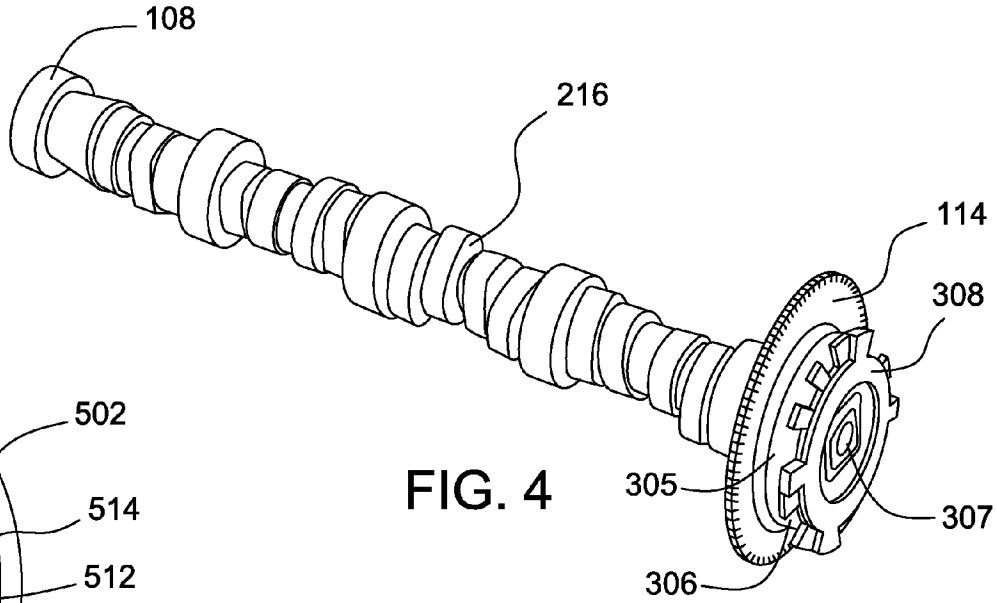
FIG. 4 is a perspective view of a camshaft and cam phaser in accordance with the disclosure.
Figure 5:
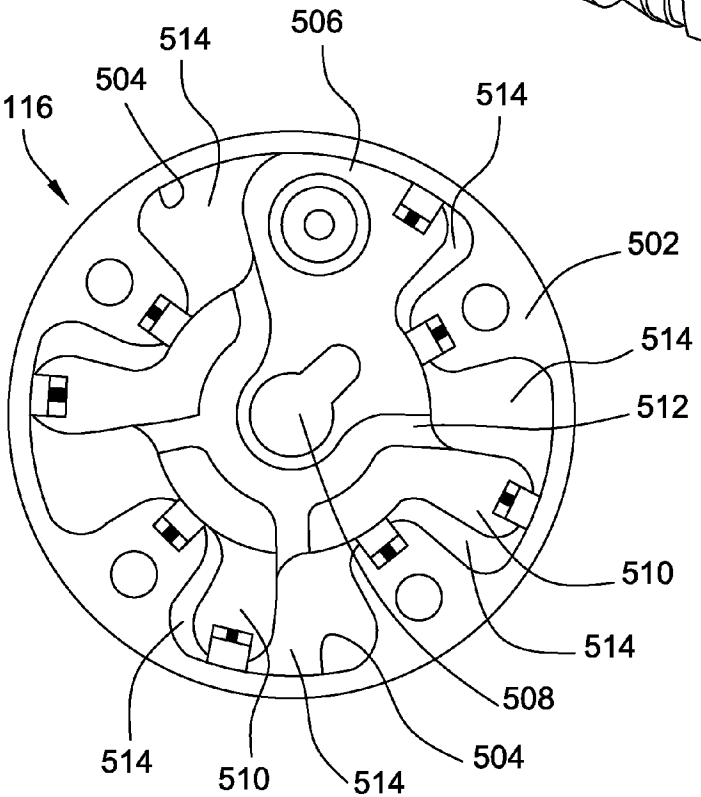
FIG. 5 is an end view of cam phaser with the cover plate removed.
Figure 8:
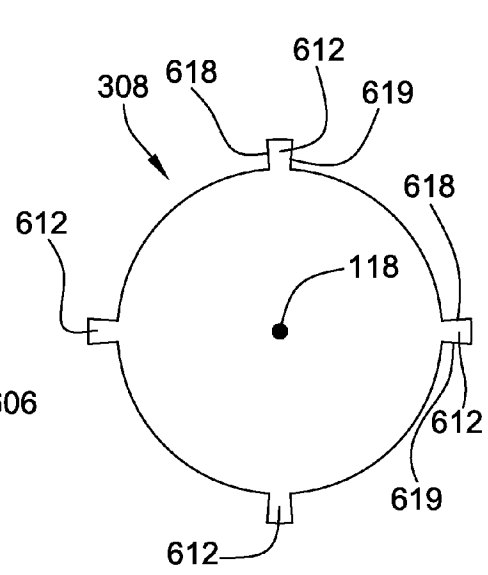
FIG. 8 is a diagrammatic end view of the second target wheel.
Figure 7:
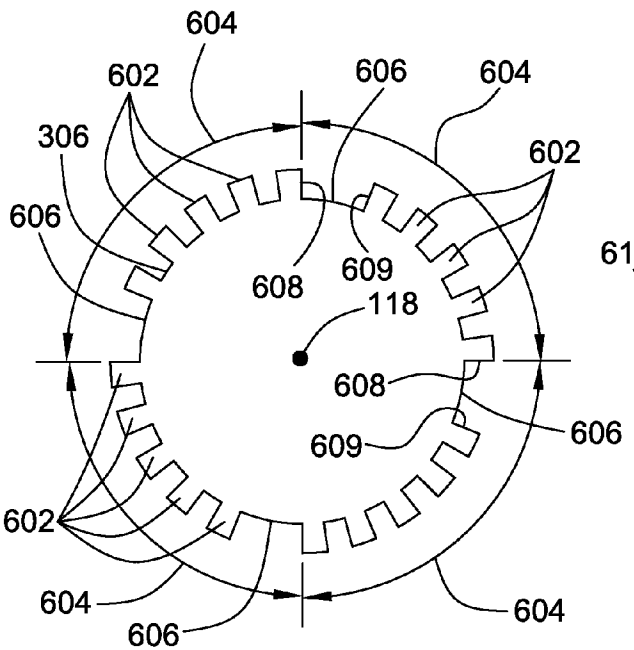
FIG. 7 is a diagrammatic end view of the first target wheel.
Figure 6:
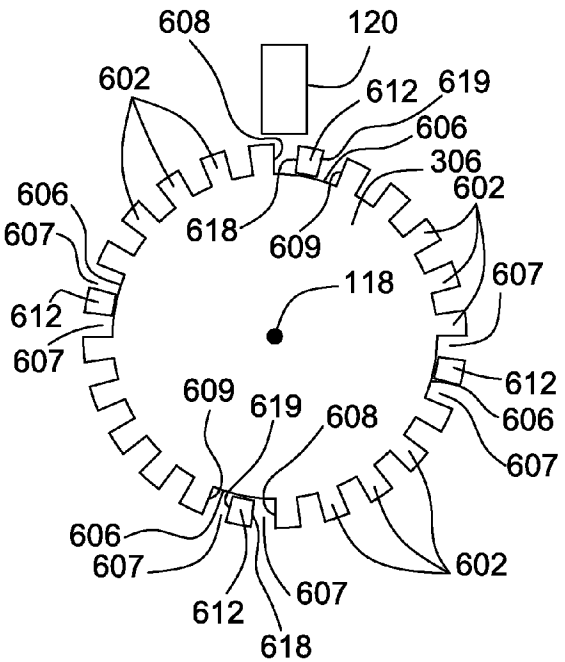
FIG. 6 is a diagrammatic end view of the interaction between a pair of target wheels.

Referring to FIGS. 3-5, a cam phaser sub-assembly 302 is depicted with one cam phaser 116 and one control valve sub-assembly 304 associated with each camshaft. Each cam phaser 116 includes one sprocket 114 for engaging and being driven by the engine timing belt or chain 112. Each camshaft 108, 110 extends through sprocket 114 and is configured to rotate independently of the sprocket. A generally cylindrical lobed stator 502 is fixed to sprocket 114 by a plurality of fasteners and has a plurality of radial chambers or lobes 504. A vaned rotor 506 is positioned within lobed stator 502 and has a central bore 508 and a plurality of vanes 510. The number of vanes 510 of vaned rotor 506 corresponds to the number of lobes 504 of lobed stator 502. Vaned rotor 506 is provided with fluid passageways 512 for delivering pressurized fluid such as oil to opposite sides of each vane 510 in each lobe 504 in order to adjust the angular position of the vaned rotor 506 relative to the lobed stator 502. A cover plate 305 is sealingly and concentrically disposed against the lobed stator 502 to seal the lobes 504 and vaned rotor 506. The cam phaser 116 is secured to the end of each camshaft by a bolt 307 which also fixes the vaned rotor 506 of the cam phaser 116 to the camshaft without engaging the lobed stator 502. As such, each camshaft 108, 110 and vaned rotor 506 may rotate relative to the lobed stator 502 and sprocket 114 by an amount equal to the spacing or clearance 514 between the vanes of the vaned rotor and the lobes of the lobed stator.

Referring to FIGS. 6-9, a generally planar first target wheel 306 has a plurality of first projections such as first teeth 602 extending radially about the axis of rotation 118 of the camshaft 108, 110 and is mounted so as to be fixed to the lobed stator 502. As depicted, first target wheel 306 is rotationally symmetrical and includes four quadrants 604 with four identical arrays of five equally spaced first teeth 602 with a position designating space or opening 606 within each array. In other words, first target wheel 306 has twenty first teeth 602 spaced about the outer perimeter as if the first target wheel were formed with twenty-four first teeth fifteen degrees apart and every sixth tooth has been removed to create the opening. Each opening 606 has a forward edge 608 and a trailing edge 609 for triggering wheel speed sensor 120. As depicted, the width of each opening 606 is approximately equal to the width of three first teeth 602. It is contemplated that the opening 606 may have a different width so long as sufficient clearance area 607 is provided within opening 606 to permit movement of a second tooth 612 therein. Rotation of first target wheel 306 about the axis of rotation 118 of camshaft 108, 110 causes first teeth 602 and thus openings 606 to rotate or move along a generally circular path within the plane of the first target wheel 306 and generally perpendicular to the axis of rotation.

A generally planar second target wheel 308 has a plurality of position designating tabs or second projections such as second teeth 612 extending or projecting in a direction generally parallel to the axis of rotation 118 of the camshaft 108, 110. Second target wheel 308 is mounted so as to be fixed to the camshaft 108, 110 and vaned rotor 506. As depicted, second target wheel 308 is rotationally symmetrical and includes four quadrants with one second tooth 612 in each quadrant. Each second tooth 612 has a forward edge 618 and a trailing edge 619 for triggering wheel speed sensor 120. The second teeth 612 are equally spaced apart on second target wheel 308 and, as such, are ninety degrees apart. Rotation of second target wheel 308 about the axis of rotation 118 of camshaft 108, 110 causes second teeth 612 to rotate or move along a generally circular path generally perpendicular to the axis of rotation.

The first target wheel 306 and the second target wheel 308 are positioned adjacent each other along the axis of rotation 118 of the camshaft 108, 110 with a clearance or gap 622 therebetween. Each second tooth 612 extends into the plane of the first target wheel 306 and is aligned with and projects into one of the openings 606 thereof in order to create pairs of openings and second teeth. The first target wheel 306 is fixed to the lobed stator 502 so that the first target wheel rotates with the lobed stator. The second target wheel 308 is fixed to the vaned rotor 506 and the camshaft 108, 110 so that the second target wheel rotates with the vaned rotor and the camshaft. In an alternate embodiment, cam phaser sub-assembly 302 may be configured so that first target wheel 306 is fixed to the vaned rotor 506 and the camshaft 108, 110 and the second target wheel 308 is fixed to the lobed stator 502. Rotation of the camshaft 108, 110 and the cam phaser 116 will cause the openings 606 and the second teeth 612 to rotate or move along a generally circular path about the axis of rotation 118 of the camshaft 108, 110. Rotation of the sprocket 114 while the vaned rotor 506 is fixed relative to the lobed stator 502 will cause rotation of the openings 606 and the second teeth 612 about the axis of rotation but without relative motion therebetween. Rotation of the vaned rotor 506 relative to the lobed stator 502 will cause rotational motion of the openings 606 relative to the second teeth 612. Clearance areas 607 are dimensioned to permit rotational movement of second teeth 612 within openings 606 without impeding the rotation of vaned rotor 506 relative to lobed stator 502.

Figure 9:
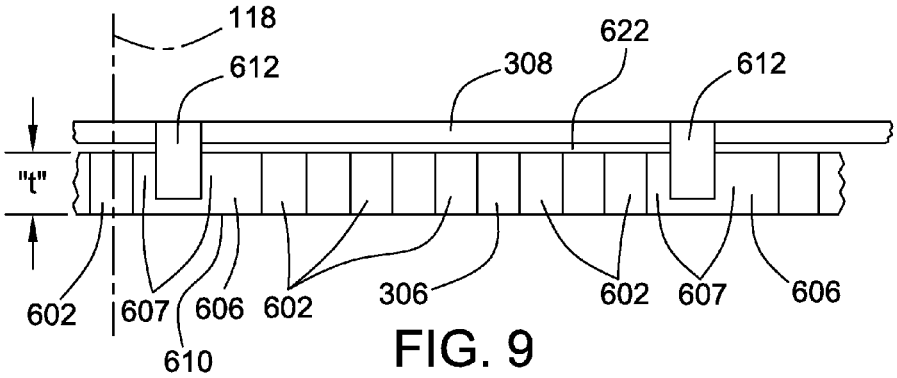
FIG. 9 is an enlarged diagrammatic top view of the interaction between a pair of target wheels.

As best seen in FIG. 9, each second tooth projects into one of the openings 606 of the first target wheel 306. Although depicted as extending into the opening 606 to a position approximately eighty percent of the distance across the first teeth 602 and openings 606 (i.e., in the direction of the thickness of the first target wheel 306), the second teeth 612 may extend a longer or shorter distance or thickness "t" provided that they extend a sufficient distance so wheel speed sensor 120 is able to sense or detect the passage of each second tooth. For example, the second teeth 612 could extend to or past the far edge 610 of the first target wheel 306 provided that such configuration does not create an obstacle to relative rotation between the lobed stator 502 and the vaned rotor 506 as well as any other components of the cam phaser 116. In another example, the first teeth have a thickness "t" and it is believed that configuring the second teeth to extend at least to the midpoint or fifty percent of the distance across the thickness will provide a sufficient surface or edge to be detected by wheel speed sensor 120.

Figure 10:
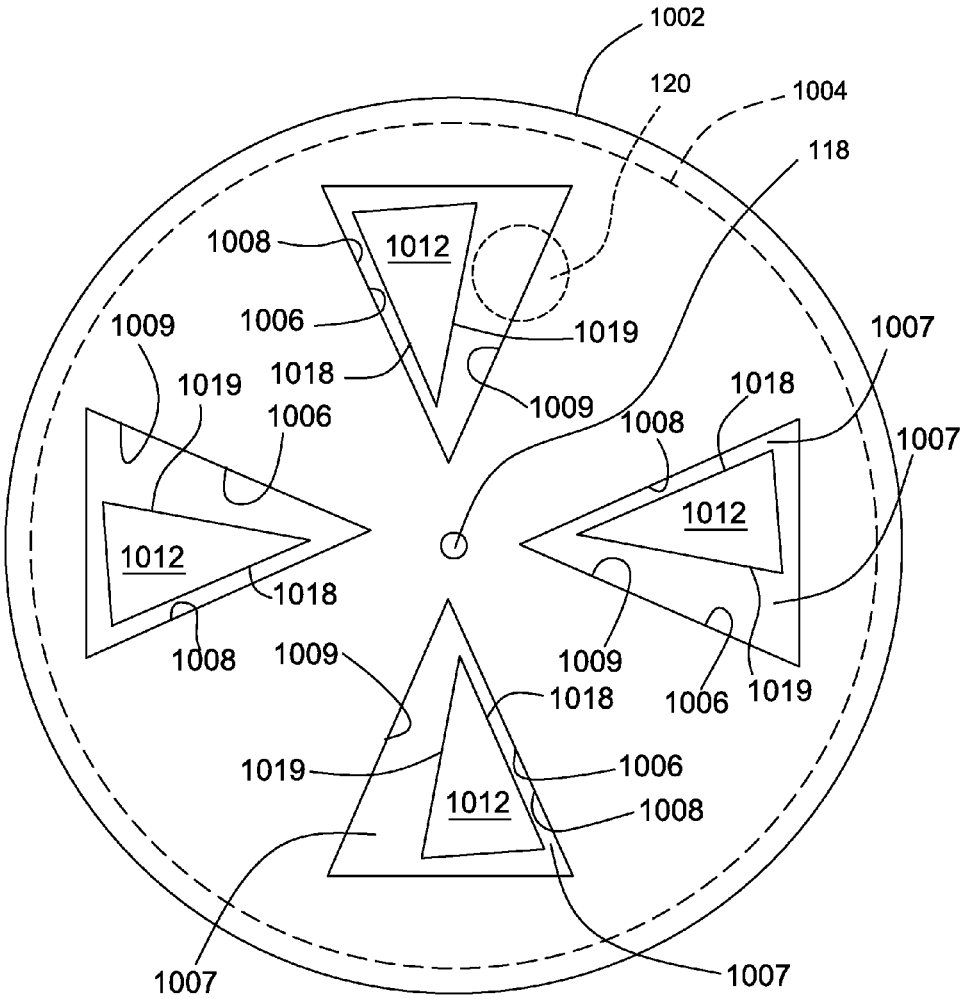
FIG. 10 is a diagrammatic end view of the interaction between a pair of target wheels of an alternate embodiment.

Other configurations of pairs of openings and second teeth that move within a common generally circular path could be utilized. For example, FIG. 10 depicts an alternate embodiment of a pair of target wheels such as generally planar third target wheel 1002 and generally planar fourth target wheel 1004. Such configuration permits the wheel speed sensor 120 to be positioned generally perpendicular to the plane of the target wheels as shown in phantom (FIG. 10) rather than along an edge of the target wheels (FIGS. 3, 9). Third target wheel 1002 is rotationally symmetrical and includes four equally spaced position designating triangular openings 1006 therein. Each triangular opening 1006 has a leading edge 1008 and a trailing edge 1009 for triggering wheel speed sensor 120. The width of triangular opening 1006 is sufficient to provide sufficient clearance area 1007 within the opening to permit rotational movement of triangular projection 1012 therein. Rotation of third target wheel 1004 about the axis of rotation 118 of camshaft 108, 110 causes triangular openings 1006 to rotate or move along a generally circular path within a plane generally perpendicular to the axis of rotation.

Fourth target wheel 1004 is rotationally symmetrical and includes four equally spaced position designating triangular projections 1012 extending or projecting from a surface thereof in a direction generally parallel to the axis of rotation 118 of the camshaft 108, 110. Each triangular projection 1012 has a leading edge 1018 and a trailing edge 1019 for triggering wheel speed sensor 120.

The third target wheel 1002 and the fourth target wheel 1004 are configured to be positioned adjacent each other along the axis of rotation 118 of the camshaft 108, 110 in a manner substantially similar to the manner in which first target wheel 306 and second target wheel 308 are mounted. Each triangular projection 1012 of fourth target wheel 1004 extends into the plane of the third target wheel 1002 and is aligned with and projects into one of the triangular openings 1006 thereof in order to create pairs of third and fourth triangular openings and projections. Rotation of the camshaft 108, 110 and the cam phaser 116 will cause the triangular openings 1006 and the triangular projections 1012 to rotate or move along a generally circular path about the axis of rotation 118 of the camshaft 108, 110. Rotation of the sprocket 114 while the vaned rotor 506 is fixed relative to the lobed stator 502 will cause rotation of the triangular openings 1006 and the triangular projections 1012 about the axis of rotation but without relative motion therebetween. Rotation of the vaned rotor 506 relative to the lobed stator 502 will cause rotational motion of the triangular openings 1006 relative to the triangular projections 1012. Clearance areas 1007 are dimensioned to permit rotational movement of the triangular projections 1012 within triangular openings 1006 without impeding the rotation of vaned rotor 506 relative to lobed stator 502.

Although referred to as target wheels, the first target wheel 306 and the second target wheel 308 could be structures of various shapes provided that they include openings and projections that rotate about the axis of rotation 118 to define a generally circular path. For example, the openings and projections could be formed as components of the housing of the lobed stator 502 or the cover plate 305 or other components of the cam phaser 116. First target wheel 306 and second target wheel 308 are depicted with four pairs of openings and second teeth. Other numbers of pairs may be used with a greater number generally increasing the accuracy of the measurement and a lesser number generally decreasing the accuracy of the measurement.

The wheel speed sensor 120 may be any type of sensing device including Hall effect sensors, variable reluctance sensors and other devices that will perform a similar function. The wheel speed sensor 120 detects the forward edges 608 and the trailing edges 609 of the openings 606 on the first target wheel 306 and the forward edges 618 and the trailing edges 619 of the second teeth 612 on the second target wheel 308 and provides a series of signal pulses to an electronic controller 122. Based upon the signal pulses, the electronic controller 122 determines the phase angle between the camshaft 108, 110 and the crankshaft 106. The electronic controller 122 may be any type of controller such as a single microprocessor or a plurality of microprocessors and could also include additional microchips and components for random access memory, storage, and other functions as necessary to enable the functionalities described herein.

Control valve sub-assembly 304 includes a spool valve (not shown) operative to control the passage of pressurized fluid from the hydraulic system 124 within the cam phaser 116. Varying the axial position of the spool valve varies the amount of pressurized fluid delivered to opposite sides of vanes 510 of vaned rotor 506 and the rotational position of the vanes 510 in the lobes 504 of lobed stator 502 and, thus, the phase relationship between the sprocket 114 and the camshaft 108, 110. Electronic controller 122 may provide signals for controlling the hydraulic system 124 and control valve sub-assembly 304.

In operation, the crankshaft 106 rotates and drives the sprockets 114 associated with each camshaft via timing belt or chain 112. The rotation of sprockets 114 causes the cam phasers 116 to rotate. As the cam phasers 116 rotate, the openings 606 on the first target wheel 306 and the second teeth 612 on the second target wheel 308 rotate together and pass wheel speed sensor 120. Movement of each forward edge and trailing edge past the sensor creates a series of signals that are received by electronic controller 122. Electronic controller 122 determines the relative angular difference between the first target wheel 306 and the second target wheel 308 based upon the timing of the signals received from the wheel speed sensor 120. The electronic controller 122 then utilizes the relative angular difference between the target wheels to determine the relative angular difference between the crankshaft 106 and each camshaft 108, 110. Depending on the desired operating conditions, electronic controller may send a signal to an actuation system such as hydraulic system 124 to change the relative angular difference the lobed stator 502 and the vaned rotor 506 in order to change the operating characteristics of internal combustion engine 100. If the relative angular difference between the lobed stator 502 and the vaned rotor 506 is changed, the relative angular difference between the openings 606 of the first target wheel 306 and the second teeth 612 of the second target wheel 308 will change and such change will be monitored and confirmed by the electronic controller The configuration of first and second rotating members in which the first rotating member has an opening and the second rotating member has a projection located within the opening provides a space efficient manner of sensing the relative angular difference between first and second rotating members. In addition, the structure provides the further advantage of permitting a sensor to be located in alternate orientations by changing the orientation and location of the opening and projection associated with the first and second rotating members.

INDUSTRIAL APPLICABILITY

The industrial applicability of the system described herein will be readily appreciated from the foregoing discussion. The present disclosure is applicable to many types of systems having adjacent members that rotate relative to each other. One such system is an internal combustion engines having variable valve phasing. Such internal combustion engines may adjust valve phasing during engine operation based on various operating parameters such as engine speed, engine load, altitude, fuel quality, and others factors. It may be desirable to change the valve phasing based upon changes in engine speed and load, changes in altitude, as well as changes in fuel quality in order to change the operating characteristics of an engine such as to dynamically increase the performance or the efficiency of the engine.

During the course of operating an engine, it is necessary to monitor the relative angular difference between the camshaft and the crankshaft. In large engines, tolerance stack-up and torsional issues may impact the accuracy of the relationship between the valves and pistons obtained by monitoring the relative angular difference between the camshaft and the crankshaft. Torsional affects within the system including the crankshaft, gear train, and camshaft may cause inconsistency in the measurement and monitoring of the relationship between the camshaft and the crankshaft. Moving the measurement points close together reduces the impact of the torsional noise and inconsistency in order to provide more consistent measurement of the relative angular difference between the crankshaft and camshaft.

While operating the engine, a system having a pair of adjacent target wheels may be used to monitor the relative angular difference between the crankshaft and camshaft. A first target wheel has an opening and rotates about an axis of rotation to move the opening along a generally circular path within a plane generally perpendicular to the axis of rotation. A second target wheel adjacent the first target wheel also rotates about the axis of rotation. The second target wheel has a second projection projecting into the opening of the first target wheel with the second projection being movable along the generally circular path and about the axis of rotation. A single sensor is positioned adjacent the generally circular path and senses movement of the opening and the second projection past the sensor. An electronic controller may be used to process signals from the sensor to determine relative angular difference between the first target wheel and the second target wheel.

In addition, the system may include a hydraulic system having a cam phaser to change the relative angular difference between the first target wheel and the second target wheel and thus also change the relative angular difference between the camshaft and the crankshaft in order to change the operating characteristics of an engine.

It will be appreciated that the foregoing description provides examples of the disclosed system and technique. However, it is contemplated that other implementations of the disclosure may differ in detail from the foregoing examples. All references to the references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for sensing a relative angular difference between first and second rotating members, the system comprising:

a first target wheel having an opening, the first target wheel being rotatable about an axis of rotation to move the opening along a generally circular path within a plane generally perpendicular to the axis of rotation;

a second target wheel adjacent the first target wheel and being rotatable about the axis of rotation, the second target wheel having a second projection, the second projection projecting into the opening, the second projection being rotatable along the generally circular path and about the axis of rotation;

a sensor adjacent the generally circular path for sensing movement of the opening and the second projection past the sensor; and a cam phaser having a lobed stator and a vaned rotor, the first target wheel being secured to one of the lobed stator and the vaned rotor, the second target wheel being secured to another of the lobed stator and the vaned rotor.

2. The system of claim 1, wherein the first target wheel is secured to the lobed stator and the second target wheel is secured to the vaned rotor.

3. The system of claim 1, wherein the first target wheel and the second target wheel are rotationally symmetrical about the axis of rotation.

4. The system of claim 1, further including an electronic controller configured to process signals from the sensor and determine the relative angular difference between the first target wheel and the second target wheel.

5. The system of claim 4, wherein the electronic controller utilizes the relative angular difference between the first target wheel and the second target wheel to control signals to an actuation system operative to control the relative angular difference between the first target wheel and second target wheel.

6. The system of claim 5, wherein the actuation system is a hydraulic system.

7. The system of claim 1, further including a clearance area within the opening to permit movement of the second projection therein and relative rotation of the first target wheel and the second target wheel.

8. The system of claim 1, further including a plurality of spaced apart first teeth within the plane of the generally circular path, and a plurality of spaced apart second teeth, the second teeth extending into the plane of the generally circular path.

9. The system of claim 8, wherein the second teeth are evenly spaced around the second target wheel about the axis of rotation.

10. An internal combustion engine, comprising:

at least one cylinder having a reciprocating piston therein;

at least one valve associated with the at least one cylinder and operable by a camshaft, the camshaft rotating about an axis of rotation, the at least one valve being configured to open and close over a predetermined range of crankshaft rotation, a cam phaser operatively associated with the camshaft and including a lobed stator and a vaned rotor, a first target wheel being secured to one of the lobed stator and the vaned rotor, the first target wheel having an opening, the first target wheel being rotatable about the axis of rotation to rotate the opening along a generally circular path within a plane generally perpendicular to the axis of rotation, a second target wheel adjacent the first target wheel, the second target wheel being rotatable about the axis of rotation and secured to another of the lobed stator and the vaned rotor, the second target wheel having a second projection projecting into the opening of the first target wheel, the second projection being rotatable along the generally circular path and about the axis of rotation;

a sensor adjacent the generally circular path for sensing movement of the opening and the second projection past the sensor; and an electronic controller configured to process signals from the sensor and determine a relative angular difference between the first target wheel and the second target wheel.

11. The internal combustion engine of claim 10, wherein the first target wheel is secured to the lobed stator and the second target wheel is secured to the vaned rotor.

12. The internal combustion engine of claim 10, wherein the electronic controller utilizes the relative angular difference between the first target wheel and the second target wheel to control signals to an actuation system operative to control the relative angular difference between the first target wheel and the second target wheel.

13. The internal combustion engine of claim 10, further including a clearance area within the opening to permit movement of the second projection therein and relative rotation of the first target wheel and the second target wheel.

14. The internal combustion engine of claim 10, wherein the first target wheel has a plurality of spaced apart first teeth within the plane of the generally circular path and defines a plurality of openings, the second target wheel has a plurality of spaced apart second teeth, and each second tooth extends into one of the openings and the plane of the generally circular path.

15. The internal combustion engine of claim 14, wherein the first teeth have a first thickness generally perpendicular to the generally circular path and the second teeth extend at least past a midpoint of the thickness of the first teeth.

16. The internal combustion engine of claim 14, wherein the second teeth are evenly spaced about the second target wheel around the axis of rotation.

17. The internal combustion engine of claim 10, wherein the first target wheel and the second target wheel are rotationally symmetrical about the axis of rotation.

18. A cam phaser sub-assembly for operatively coupling with a camshaft, comprising:

a lobed stator configured to be driven by a crankshaft;

a vaned rotor fixed to the camshaft, the vaned rotor being positioned within and configured to rotate relative to the lobed stator;

a first target wheel secured to one of the lobed stator and the vaned rotor, the first target wheel having a plurality of spaced apart openings and being rotatable about an axis of rotation of the camshaft to move the openings along a generally circular path within a plane generally perpendicular to the axis of rotation; and a second target wheel adjacent the first target wheel and secured to another of the lobed stator and the vaned rotor, the second target wheel having a plurality of spaced apart second projections and being rotatable about the axis of rotation, each second projection projecting into one of the openings, the second projections being rotatable along the generally circular path and about the axis of rotation.

* * * * *